United States Patent [19]

Isozaki et al.

[11] Patent Number: 5,072,644

[45] Date of Patent: Dec. 17, 1991

[54] SYNTHETIC RECORDING DEVICE IN AN AUTOMATIC PERFORMANCE PIANO

[75] Inventors: Yoshimasa Isozaki; Yasuhiko Oba, both of Hamamatsu, Japan

[73] Assignee: Yamaha Corporation, Hamamatsu, Japan

[21] Appl. No.: 557,381

[22] Filed: Jul. 24, 1990

[30] Foreign Application Priority Data

Jul. 28, 1989 [JP] Japan ..... 1-88886[U]

[51] Int. Cl.[5] ..... G10H 1/20; G10H 7/00

[52] U.S. Cl. ..... 84/609; 84/619; 84/445

[58] Field of Search ..... 84/609-615, 84/619, 634-643, DIG. 29, 445

[56] References Cited

U.S. PATENT DOCUMENTS

| | | | |
|---|---|---|---|
| 3,890,871 | 6/1975 | Oberheim | 84/445 X |
| 4,406,203 | 9/1983 | Okamoto et al. | 84/445 X |
| 4,449,437 | 5/1984 | Cotton, Jr. et al. | 84/613 |
| 4,724,736 | 2/1988 | Isozaki | 84/445 X |
| 4,991,484 | 2/1991 | Kawashima | 84/615 X |

*Primary Examiner*—Stanley J. Witkowski

*Attorney, Agent, or Firm*—Spensley Horn Jubas Lubitz

[57] ABSTRACT

A synthetic recording device in an automatic performance piano includes a key range setting circuit for setting a range of keys in which record performance information is to be generated, a transposition circuit for transposing, when playback performance information read from a memory corresponds to a key within this key range, the playback performance information by a predetermined amount of transposition, a piano performance unit for performing playback in response to the transposed playback performance information, a selection circuit for selecting key operation information corresponding to a key in the key range set by the key range setting circuit and outputting the selected information as record performance information, a delay circuit for delaying the playback performance information by a predetermined period of time, and a synthetic recording circuit for synthesizing the delayed playback performance information and the record performance information and providing the synthesized information to be stored in the memory. An optimum transposition is automatically made by a simple operation by a performer for designating the key range in which record performance information is to be generated and a record part and a playback part in the keyboard can be clearly distinguished from each other.

6 Claims, 9 Drawing Sheets

RECORDING PART

32 <—> 55 KEY

SYNTHETIC RECORDING DEVICE IN AN AUTOMATIC PERFORMANCE PIANO

BACKGROUND OF THE INVENTION

This invention relates to a synthetic recording device in an automatic performance piano capable of conducting accurate synthetic recording (hereinafter sometimes referred to as "overdubbing") with a simple operation.

There is known an automatic performance piano which reads performance data stored in a storage medium and conducts an automatic performance by driving the keyboard and pedals of the piano in response to the read out information.

FIG. 10 shows an example of construction of a conventional automatic performance piano. In this figure, an automatic performance piano is constructed generally of a grand piano main body 10 and a controller 20. The controller 20 contains an FDD (floppy disk drive) for storing performance data and a CPU (central processing unit) for performing control of the entire automatic performance piano. The grand piano main body 10 is connected to the controller 20 through a cable CA.

In the grand piano main body 10, a pedal 11 is pivotably connected to a pedal support 11*a*. A push-up rod 11*b* is pivotably connected to the pedal 11 to move in the vertical direction in an interlocking motion with the pivotal motion of the pedal 11. This push-up rod 11*b* is connected to a mechanism such as a damper which corresponds to the pedal operation. The push-up rod 11*b* penetrates a pedal drive solenoid 11*c*. A plunger (not shown) is provided at a location in the push-up rod 11*b* opposing the pedal drive solenoid 11*c*. In the automatic performance mode, a drive current corresponding to the performance data is supplied to the pedal drive solenoid 11*c* to actuate the plunger which in turn causes the push-up rod 11*b* to move upwardly.

Each key 12 of a keyboard is pivotably mounted to a ballance pin 12*a*. An action 12*b* is connected to each key 12 so that, when the key 12 has been struck, a hammer 12*c* is rotated to strike a string 12*d* which is stretched above. A key drive solenoid 12*e* and a key sensor 12*f* are respectively provided for each key 12. In the automatic performance mode, a drive current corresponding to the performance data is supplied to the key drive solenoid 12*e* to drive the key 12.

The operation of the prior art automatic performance piano will be briefly described. In the automatic performance mode, the performance data is sequentially read from the FDD of the controller 20. A playback event is extracted from this performance data and is supplied to the grand piano main body 10 through the cable CA. In the grand piano main body 10, a drive current is supplied to a corresponding one of the key drive solenoid 12*e* and the pedal drive solenoid 11*c* in accordance with the playback event and a corresponding one of the keys 12 or the pedals 11 is thereby driven to conduct the automatic performance.

In the write mode, the operation of the key 12 is detected by the key sensor 12*f* and a corresponding operation event is supplied to the controller 20 through the cable CA. Performance data is produced in the controller 20 on the basis of this operation event and stored in the FDD.

There is a demand for a so-called overdubbing function to the above described automatic performance piano. For realizing this overdubbing, it is conceivable to detect a keyboard operation in the automatic performance mode and effect recording by superposing this operation event and a playback event one upon the other. During overdubbing, however, both an operation due to a playback event and an operation due to performance by a performer are made in the piano main body and, accordingly, operation events corresponding to the performance data and operation events corresponding to the keyboard operation by the performer exist mixedly in operation events detected in the piano main body. For preventing redundant recording of the same performance data, therefore, it is necessary to select only operation events corresponding to the keyboard operation by the performer. Since, however, operation events in the automatic performance piano are generated merely by detecting operation of keys, it is not possible to discriminate operation events corresponding to the performance data from operation events due to the keyboard operation by the performer. For this reason, a sufficiently accurate overdubbing function cannot be realized in the prior art automatic performance piano.

It has also been conceived to divide a keyboard into a key range in which recording is to be made and a key range in which playback is to be made by a setting operation made from outside and transpose performance information for playback by a predetermined amount of transposition by a setting operation made from outside thereby to transfer the range of the keys to be played back from the key range in which recording is to be made. In this method, however, the performer must determine and designate by himself an optimum amount of transposition depending upon conditions such as a range of tones of a music to be played each time an overdubbing is made with a result that operability of the automatic performance piano is deteriorated. Further, if the performer has failed to set the amount of transposition to an optimum amount, an optimum transposition cannot be obtained with resulting occurrence of disharmony in the performance.

It is an object of the invention to provide a synthetic recording device in an automatic performance piano capable of preventing redundant recording of performance data and performing an accurate overdubbing with a simple operation.

SUMMARY OF THE INVENTION

For achieving the above described object of the invention, there is provided, as schematically shown in FIG. 1, a synthetic recording device in an automatic performance piano conducting an automatic performance in response to playback performance information read from memory means 1 and, simultaneously, detecting keys operated by a performer from among keys provided in a keyboard and generating record performance information in accordance with a result of detection, and storing performance information obtained by synthesizing the record performance information and the playback performance information in the memory means 1, the synthetic recording device comprising key range setting means 7 for setting, as a record area, a range of keys in which the record performance information is to be generated, transposition means 2 for transposing, when the playback performance information corresponds to a key within the range set by the key range setting means 7, the playback performance information by a predetermined amount of transposition and outputting the transposed playback performance information, piano performance means 3 for performing playback in response to the transposed playback performance information and detecting a state of operation of keys in the keyboard to provide key operation information, selection means 4 for selecting key operation information corresponding to a key in the record area from among the key operation information provided by the piano performance means 3 and outputting the selected information as the record performance information, delay means 5 for delaying the playback performance information by a predetermined period of time determined on the basis of dynamic characteristics of a string hammering section of the automatic performance piano, and synthetic recording means 6 for synthesizing the delayed playback performance information and the record performance information and providing the synthesized information to the memory means 1 to be stored therein.

According to the invention, a range of keys in which record performance information is generated is set as a record area by the key range setting means 7. When playback performance information read from the memory means 1 corresponds to a key in the record area set by the key range setting means 7, this playback performance information is transposed by a predetermined amount of transposition by the transposition means 2 and supplied to the piano performance means 3 so that keys corresponding to the transposed playback performance information are operated to conduct the automatic performance. When the performer has operated a key in the keyboard, the key operation state is detected by the piano performance means 3. Key operation information corresponding to a key in the record area among the detected key operation information is selected by the selection means 4 and provided as the record performance information. On the other hand, the playback performance information read from the memory means 1 is delayed by the delay means 5 by a predetermined period of time determined on the basis of dynamic characteristics of the string hammering mechanism of the automatic performance piano. The delayed playback performance information provided by the delay means 5 and the record performance information provided by the selection means 4 are synthesized by the synthetic recording means 6 and the synthesized information is stored in the memory means 1 as performance information.

According to the invention, a record part and a playback part in the piano main body can be clearly distinguished from each other whereby an accurate overdubbing can be realized. When a key in the playback performance information is within the record part, the playback performance information is automatically transposed by an optimum amount of transposition and keys outside of the record part corresponding to the transposed playback performance information are operated. Since this amount of transposition is automatically computed by setting of the record part by the performer, an excellent operability of the automatic performance piano can be achieved.

An embodiment of the invention will be described below with reference to the accompanying drawings.

BRIEF DESCRIPTION OF THE DRAWINGS

In the accompanying drawings.

DESCRIPTION OF PREFERRED EMBODIMENTS

Referring to FIGS. 2 through 9, an embodiment of the invention will be described.

Figure 1:
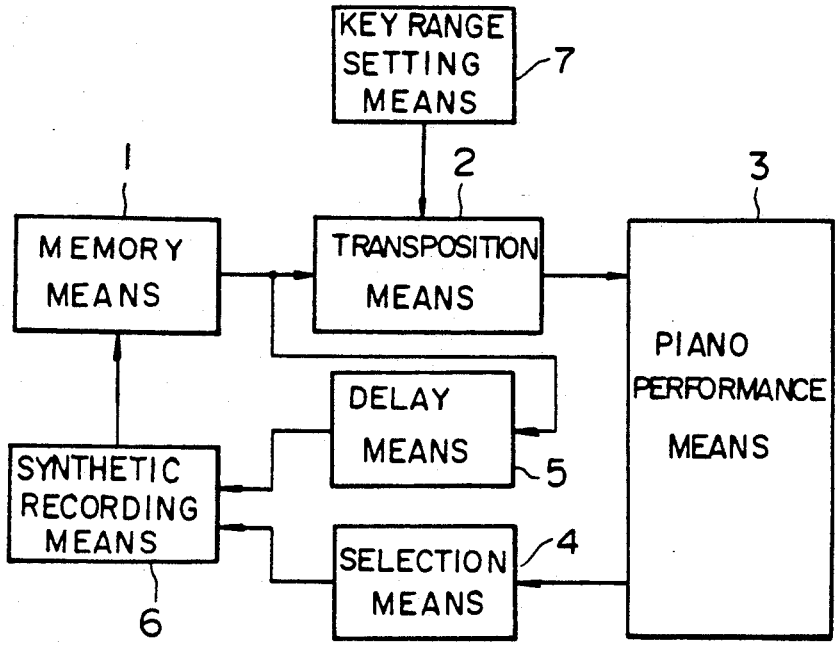
FIG. 1 is a block diagram schematically showing the basic construction of the synthetic recording device in an automatic performance piano according to the invention.
Figure 2:
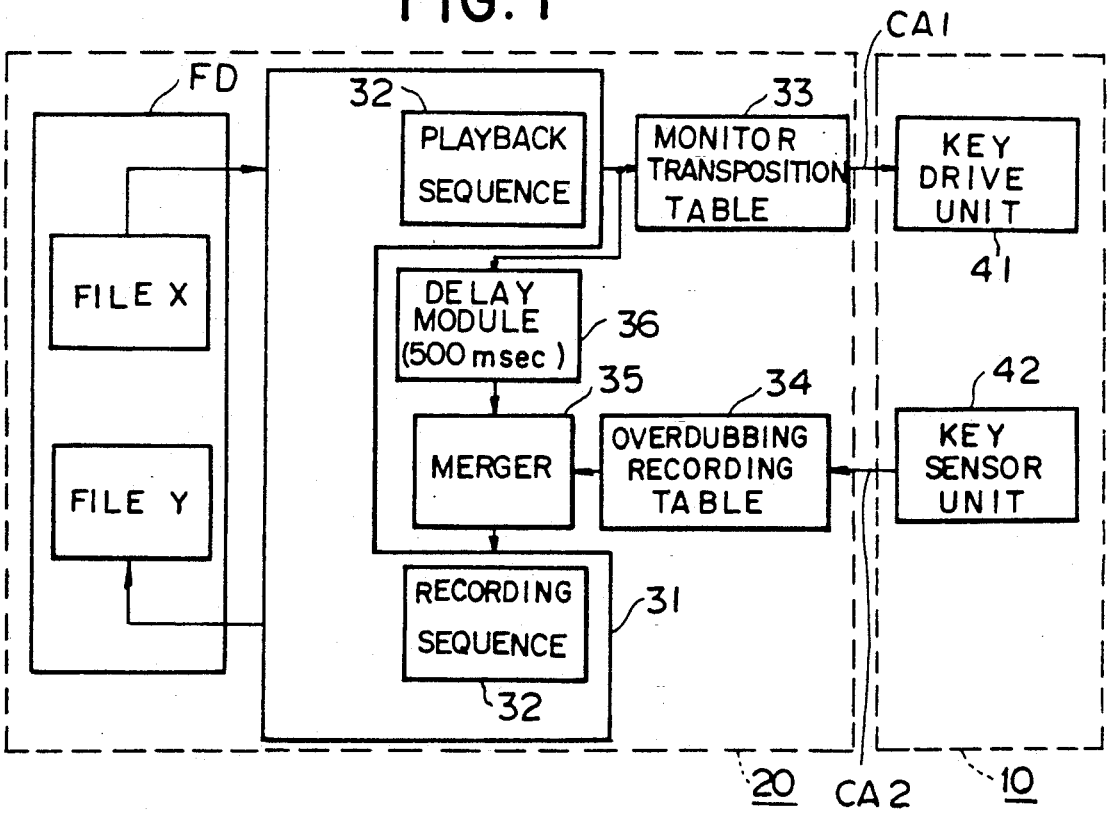
FIG. 2 is a block diagram showing an embodiment of the synthetic recording device of the invention.

FIG. 2 shows a construction of an embodiment of the synthetic recording device in an automatic performance piano according to the invention. In the figure, a sequencer 31 performs a write/read control of a floppy disk FD storing performance data. When performance data is read from the floppy disk FD, a playback sequence module 32 is started by the sequencer 31 and, when performance data is written in the floppy disk FD, a recording sequence module 37 is started by the sequencer 31.

In FIG. 2, a file X is one in which performance data has already been stored and a file Y is one for storing performance data resulting from overdubbing. The performance data stored in the file X is read out by the playback sequence module 32 of the sequencer 31 as a playback event and is converted to a monitor event in accordance with a monitor transposition table 33. The monitor transposition table 33 is a table storing key numbers of monitor events corresponding to respective key numbers of playback events. The monitor transposition table 33 is automatically prepared when the performer has designated a range of key numbers for recording by operating an operation unit (not shown). The automatic preparation of the monitor transposition table 33 will be described more fully later. The monitor event thus obtained is supplied to a key drive unit 41 in the piano main body 10 through a serial signal line CA1 according to the MIDI standard. The key drive unit 41 thereupon supplies a drive current to a key drive solenoid corresponding to the key number of the monitor event whereby an automatic piano performance is made.

When the performer has operated a key in the keyboard, the operated key is detected by a key sensor unit and information of the detected key is supplied as an operation event to the controller 20 through a serial signal line CA2. An overdubbing recording table 34 stores information representing a range of key numbers which are permitted to be recorded as record events among operation events supplied from the key sensor unit 42. This overdubbing recording table 34 is automatically prepared like the monitor transposition table 33 when the performer has designated a range of keys to be recorded as will be described more fully later. Among operation events supplied from the key sensor unit 42, those of the key numbers within the range permitted by the overdubbing recording table 34 only are delivered out as record events and supplied to a merger module 35.

The playback event read out by the playback sequence module 32 of the sequencer 31 is branched and applied to a delay module 36 for being controlled in lapse of time thereafter. Performance data which has elapsed a predetermined length of time (in the present embodiment, 500 msec) is supplied from the delay module 36 to the merger module 35 to be merged with record performance data. By this arrangement, a delay time in the string hammering mechanism in the piano main body 10 is compensated. The merger module 35 produces performance data resulting from synthesis of the performance data with the record performance data and this synthesized performance data is stored and accumulated in the file Y by the recording sequence module 37 of the sequencer 31. Upon completion of preparation of all performance data, contents of the file X in the floppy disk FD is deleted and contents of the file Y only are maintained. The processing modules of FIG. 2 are sequentially started by the CPU provided in the synthetic recording device and the above described processing is sequentially performed. The monitor transposition table 33 and the overdubbing recording table 34 are provided in an unillustrated RAM (random-access memory).

Figures 3, 5:
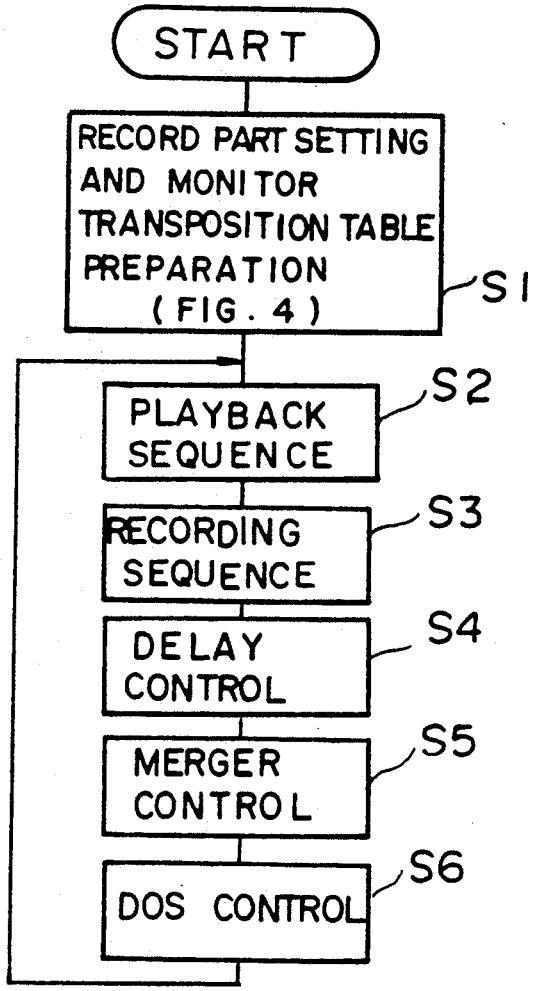
FIG. 3 is a flow chart showing a main flow of the operation of this embodiment.
FIG. 5 is a diagram showing an example of display of a record part in the same embodiment.
Figure 4A:
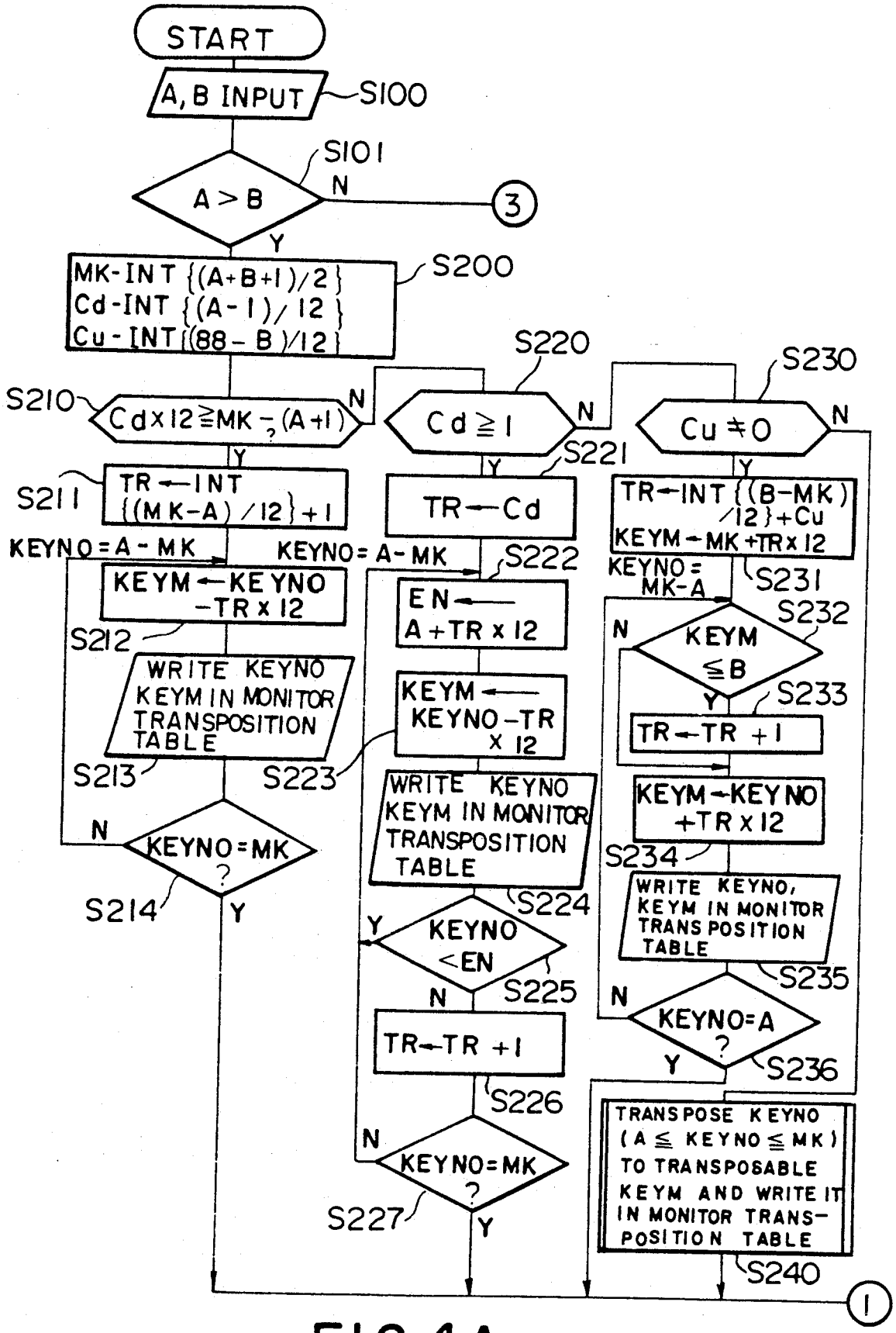
FIGS. 4A to 4D are flow charts showing processing flow of subroutines for executing setting of a record part and automatic preparation of a monitor transposition table.
Figure 4B:
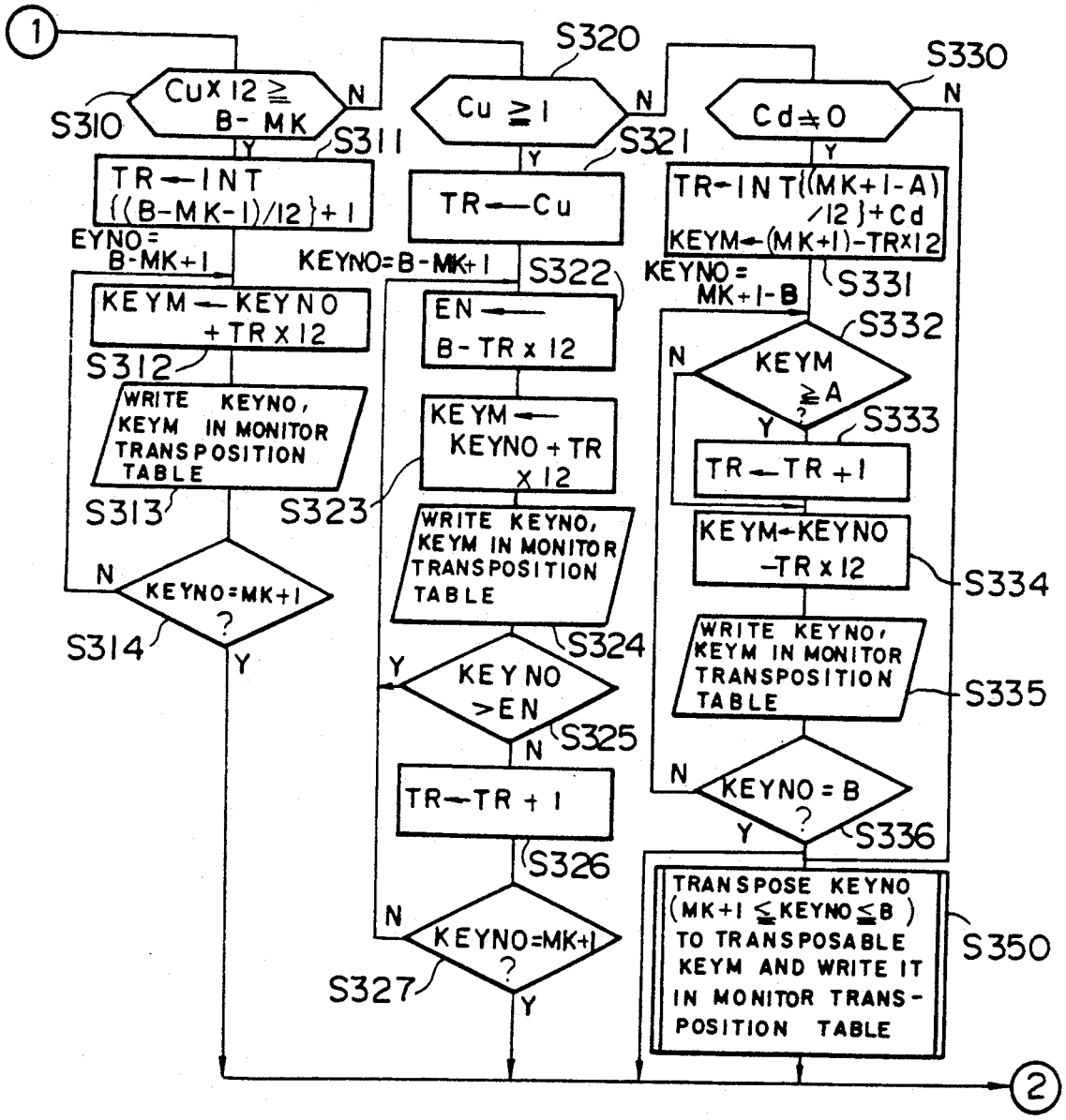
Figure 4C:
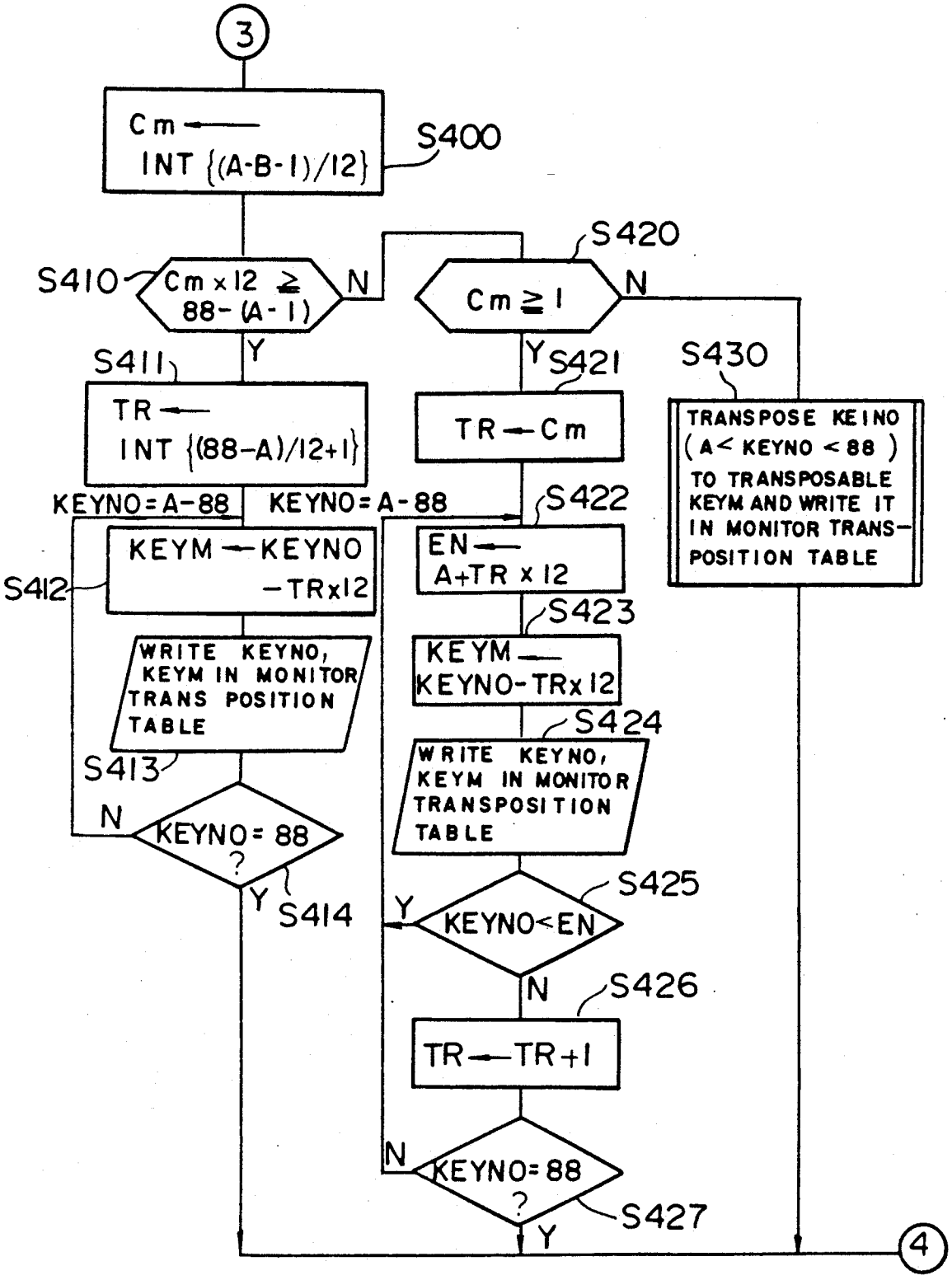
Figure 4D:
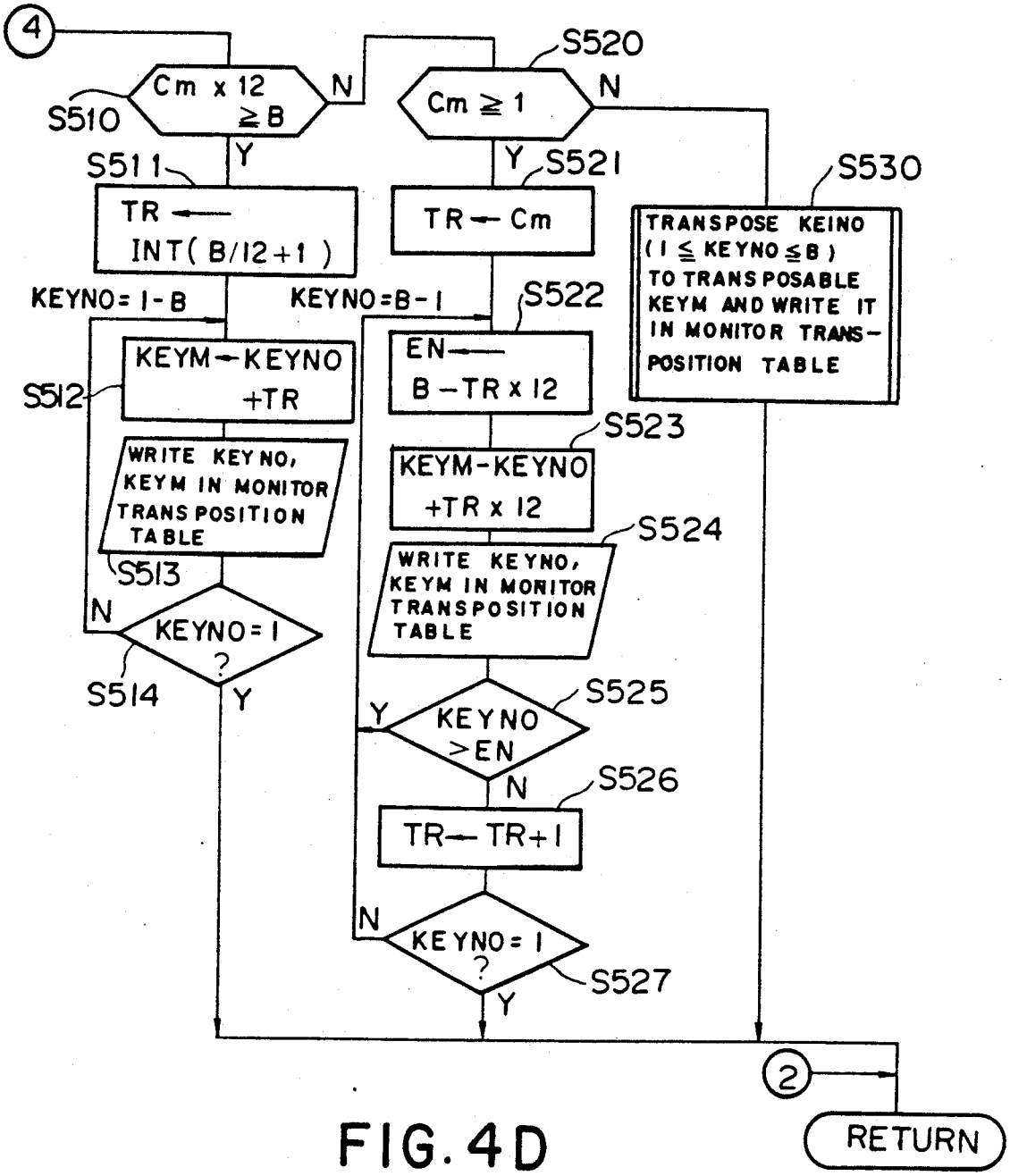

FIG. 3 is a flow chart showing the operation of the CPU in this synthetic recording device. When the performer has designated start of overdubbing by performing a predetermined operation, the CPU proceeds to step S1 in which the subroutines shown in FIGS. 4A through 4D are performed.

Figure 6:
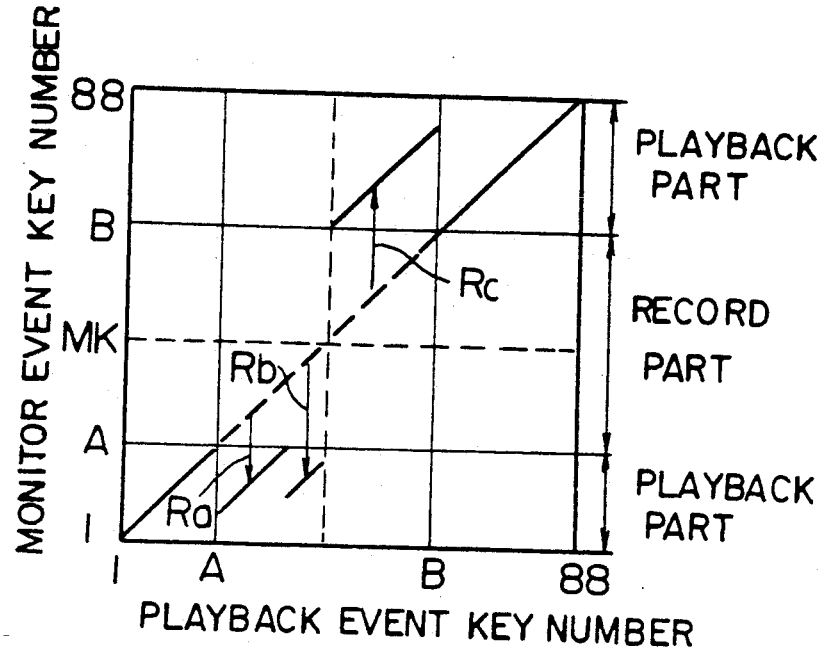
FIGS. 6 and 7 are graphs illustrating conversion from a playback event key number to a monitor event key number in the same embodiment.
Figure 7:
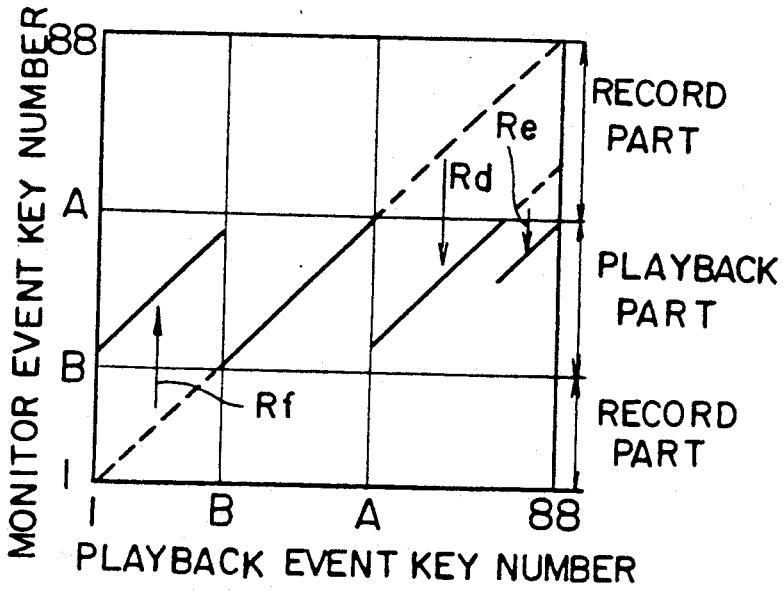

Prior to start of overdubbing, the performer inputs in the CPU a range A, B (where A represents the lower limit of the key number and B represents the upper limit of the key number) of key numbers to be recorded and a predetermined period of time (e.g., 500 msec as in the present embodiment) by operating a switch or a keyboard of an unillustrated operation unit. The CPU upon receipt of these data displays the range of key numbers to be recorded on a display panel as shown in FIG. 5 (step S100 in FIG. 4A). Responsive to the input data A, B, the CPU simultaneously writes, in the RAM, information representing a range of record part as the overdubbing recording table 34. In a case where a middle tone range is used as the record part and low and high tone ranges are used as the playback part, the range A, B becomes $A<B$ as shown in FIG. 6 whereas in a case where high and low tone ranges are used as the record part and a middle tone range is used as the playback part, the range A, B becomes $A>B$ as shown in FIG. 7.

As the subroutine proceeds to step S101, whether or not the lower limit A of the key number to be recorded is smaller than the upper limit B of the key number to be recorded is judged. If result of the judgement is YES, i.e., setting of the record part is one shown in FIG. 6, the subroutine proceeds to step S200 in which a middle key number MK in the record part, an octave number Cd of the playback part on the lower tone side in the record part and an octave number Cu of the playback part on the higher tone side in the record part are computed by operating the following formulas (1) to (3). In the formula (3), the numeral 88 represents the key number of the highest tone in the automatic performance piano.

$$MK \leftarrow INT\{(A+B+1)/2\} \quad (1)$$

$$Cd \leftarrow INT\{(A-1)/12\} \quad (2)$$

$$Cu \leftarrow INT\{(88-B)/12\} \quad (3)$$

The subroutine then proceeds to step S210 in which whether or not $Cd \times 12 \geqq MK-(AK+1)$ exists, i.e., whether or not the respective key numbers in the half area of the lower tone side in the record part can be transposed to an area of the lower tone side in the playback part, is judged. If result of the judgement is YES, the subroutine proceeds to step S211 in which a transposition octave number TR is computed by the following formula (4):

$$TR \leftarrow INT\{(MK-A)/12+1\} \quad (4)$$

By transposing Key numbers KEYNO belonging to the range A to MK to the lower tone side by TR octaves, a processing of computing a monitor key number KEYM (step S212) and a processing of writing a key number KEYNO in the playback event and a monitor key number KEYM corresponding thereto in the monitor transposition table 33 (step S212, S214) are repeated. In this manner, a table of monitor event key numbers corresponding to respective key numbers in the half area of the lower tone side in the record part is obtained.

If the tone range of the lower tone side in the playback part is narrow and therefore $Cd \times 12 < MK-(A+1)$, result of the judgement in step S210 becomes NO and the subroutine proceeds to step S220 in which whether $Cd \geqq 1$ exists or not is judged. If result of the judgement is YES, i.e., the lower tone side in the playback part is one octave or over, the subroutine proceeds to step S221 in which the transposition octave number TR is initially set to Cd. Then, the following steps S222 to S226 are executed with respect to the key numbers KEYNO belonging to the range A to MK.

First, in step S222, a control variable EN of the record part is initially set to $A+TR \times 12$. Then, the subroutine proceeds to step S223 in which the monitor key number KEYM is computed by transposing the key number KEYNO to the lower tone side by TR octaves. The subroutine then proceeds to step S224 in which the key number KEYNO and the corresponding monitor key number KEYM are written in the monitor transposition table 33. The subroutine then proceeds to step S225 in which whether or not the key number KEYNO is smaller than the control variable EN is judged. If result of the judgement is YES, the key number KEYNO is incremented and steps S221 to S224 are executed again. When the key number KEYNO has been incremented to the control variable EN, result of the judgement in step S225 becomes NO and the subroutine proceeds to step S226 in which the transposition octave number TR is increased by one octave. The key number KEYNO at this time is examined (step S227) and the subroutine returns to step S222 if the key number KEYNO is less than MK. By executing the above processing, a transposition amount of Cd octaves on the lower tone side is applied to the key numbers KEYNO in the range of A to $A+(Cd \times 12-1)$ (see the arrow Ra in FIG. 6) and a transposition amount of $Cd+1$ octaves on the lower tone side is applied to the key numbers KEYNO in the range of $A+(Cd\times 12)$ to $A+\{(Cd+1)\times 12-1$ (see the arrow Rb in FIG. 6) and, as the increase in the key number of the playback event has amounted to one octave, the amount of transposition is increased by one octave. Table information showing correspondence between the playback event key numbers KEYNO in the half area on the lower tone side (A to MK) in the record part and the monitor event key numbers KEYM resulting from the transposition by the above amounts of transposition is obtained in the monitor transposition table 33.

If the playback part on the lower tone side has not reached one octave, result of the judgement in step S220 becomes NO and the subroutine proceeds to step S230 in which whether $Cu\neq 0$ exists or not is judged. If result of the judgement is YES, i.e., the playback part on the higher tone side is one octave or over, key numbers KEYNO in the range of A to MK are transposed to the playback part on the higher tone side on octave basis sequentially from MK.

First, in step S231, the transposition octave number TR is initially set in accordance with the following formula (5):

$$TR \leftarrow INT\{(B-MK)/12\}+Cu \quad (5)$$

A key number obtained by transposing the key number MK by the octave number TR is set as an initial value to the monitor key number KEYM. This initial value is equal to or larger than the key number B and is a key number below the highest tone key number 88. Then, the following steps S232 to S235 are executed with respect to the key numbers KEYNO belonging to the range MK to A.

In step S232, whether or not the monitor key number KEYM is equal to or smaller than the upper limit B of the key numbers in the record part is judged. If result of the judgement is NO, the subroutine proceeds to step S234 in which the monitor key number KEYM is computed by transposing the key number KEYNO by TR octaves on the higher tone side. Then the subroutine proceeds to step S235 in which the key number KEYNO and the corresponding monitor key number KEYM are written in the monitor transposition table 33. The key number KEYNO is decremented and the key number KEYNO is judged (step S236). If the key number KEYNO exceeds the key number A, the subroutine returns to step 232 and repeats the above processing.

As the monitor key number KEYM is decremented with the key number KEYNO to or below the key number B, result of the judgement in step S232 becomes YES. In this case, step S233 is executed in which the transposition octave number TR is incremented. In the same manner as described above, steps S234, S235 and S236 are executed to decrement the key number KEYNO and then the subroutine returns to step S232.

If result of the judgement in step S230 is NO, i.e., both the playback parts on the higher tone side and the lower tone side are less than one octave, the subroutine proceeds to step S240. In this step, the monitor key number KEYM is computed by employing both of a processing similar to the above described steps S221 to S227 and a processing similar to the above described steps S231 to S236 and, if a proper monitor key number KEYM has been obtained at least by either processing, the monitor key number KEYM is written in the monitor transposition table 33. In this case, however, transposition in the octave unit sometimes causes the monitor key number KEYM to come outside of the playback part depending upon the key number KEYNO. For such key number KEYNO, writing of the monitor key number KEYM in the table is not made but information prohibiting playback of the particular key number KEYNO is written in the monitor transposition table 33.

In the foregoing manner, the monitor key number KEYM corresponding to the half area on the lower tone side in the record part is computed and stored in the monitor transposition table. Then, as will be described below, the monitor key number KEYM corresponding to the half area on the higher tone side in the record part is computed.

Upon completion of steps S213, S227, S236 or S240, the subroutine proceeds to step S310 in which whether or not $Cu\times 12\geqq B-MK$ exists, i.e., whether or not playback keys in the half area on the higher tone side in the record part can be transposed in their entirety to the area of the higher tone side in the playback part (this part has a tone range of Cu octave or over) is judged. If result of the judgement is YES, the subroutine proceeds to step S311 in which the transposition octave number TR is computed in accordance with the following formula (6);

$$Tr \leftarrow INT\{(B-MK-1)/12\}+1 \quad (6)$$

Then, by transposing the key number KEYNO belonging to the range B to $MK+1$ to the higher tone side by TR octaves, a processing of computing the monitor key number KEYM (step S312) and a processing of writing the key number KEYNO in the playback event and the corresponding monitor event key number KEYM in the monitor transposition table 33 (steps S313 and S314) are repeated. In this manner, the transposition amount of TR octaves is applied to each playback event in the half area on the higher tone side in the record part (see the arrow Rc in FIG. 6).

If the tone range on the higher tone side in the playback part is narrow, i.e., $Cu\times 12<B-MK$, result of the judgement in step S310 becomes NO and the subroutine proceeds to step S320 in which whether or $Cu\geqq 1$ exists or not is judged. If result of the judgement is YES, i.e., the higher tone side in the playback part is one octave or over, the subroutine proceeds to step S321 in which Cu is initially set to the transposition octave number TR. Then, steps S322 to S327 to be described below are executed for the key numbers KEYNO belonging to the range B to $MK+1$.

In step 322, $B-TR\times 12$ is set to the control variable EN. Then the subroutine proceeds to step S323 in which the monitor key number KEYM is computed by transposing the key number KEYNO to the higher tone side by TR octaves. Then the subroutine proceeds to step S324 in which the key number KEYNO and the corresponding monitor key number KEYM are written in the monitor transposition table 33. The subroutine further proceeds to step 325 in which whether or not the key number KEYNO is larger than the control variable EN is judged. If result of the judgement is YES, the key number KEYNO is decremented and steps S322 to S325 are executed again. As the key number KEYNO has been decremented to the control variable EN, result of the judgement in step 325 becomes NO and the subroutine proceeds to step S326 in which the transposition octave number TR is increased by one octave. The key number KEYNO is examined (step S327) and, if the key number KEYNO exceeds the key number MK+1, the subroutine returns to step S322. By this processing, the transposition amount of Cu octaves on the higher tone side is applied to the key numbers KEYNO in the range of B to B−(Cu×12−1) and the transposition amount of Cu+1 octaves on the higher tone side is applied to the key numbers KEYNO in the range of B−(Cu×12) to B−{(Cu+1)×12−1} and, each time the decrement from B of the key number of the playback event has reached one octave, the transposition amount is increased by one octave. Table information showing correspondence between the playback event key numbers KEYNO of the half area on the higher tone side in the record part and the monitor event key numbers KEYM resulting from transposition by the above described amounts of transposition is obtained in the monitor transposition table 33.

If the higher tone side playback part is less than one octave, result of the judgement in step S320 becomes NO and the subroutine proceeds to step S330 in which whether Cd≠0 exists or not is judged. If result of the judgement is YES, i.e., the lower tone side playback part is one octave or over, the key number KEYNO in the range of B to MK+1 is transposed to the lower tone side playback part on octave basis. First, in step S331, the transposition TR is initially set in accordance with the following formula (7):

$$TR \leftarrow INT\{(MK+1-A)/12\}+Cd \quad (7)$$

The key number obtained by transposing the key number MK+1 to the lower tone side by TR octaves is set as an initial value to the monitor key number KEYM. This initial value is a key number equal to A or less and 1 or over. A processing of steps S332 to S336 to be described below is executed with respect to the key number KEYNO belonging to the range MK+1 to B.

First, the subroutine proceeds to step S332 in which whether or not the monitor event key number KEYM is equal to or larger than the lower limit A of the key number in the record part is judged. If result of the judgement is NO, the subroutine proceeds to step S334 in which the monitor key number KEYM is computed by transposing the key number KEYNO to the lower tone side by TR octaves. Then the subroutine proceeds to step S335 in which the key number KEYNO and the corresponding monitor key number KEYM are written in the monitor transposition table 33. The key number KEYNO is decremented and, while the key number KEYNO is less than the upper limit value B of the record part (step S336), the subroutine returns to step S332 and repeats the above processing.

As the monitor key number KEYM is incremented with the key number KEYNO and has exceeded the key number A, result of the judgement in step S332 becomes YES. In this case, step S333 is executed and the transposition octave number TR is incremented. In the same manner as described above, steps S334, S335 and S336 are executed to increment the key number KEYNO and the subroutine returns to step S332.

If result of the judgement in step S330 is NO, i.e., both the higher tone side and lower tone side playback parts are less than one octave, the subroutine proceeds to step S350 in which the monitor event key number KEYM is computed by employing both a processing similar to the above described steps S321 to S327 and a processing similar to steps S331 to S336 and, if a proper monitor event key number KEYM is obtained by either processing, the monitor event key number KEYM is written in the monitor transposition table. If, as in the above described case of the range A to MK, the monitor event key number KEYM has come outside of the playback part, writing of the monitor key number KEYM in the table is not made but information prohibiting playback of the particular key number KEYNO is written in the monitor transposition table 33.

In the foregoing manner, in a case where the upper limit B of the record part is larger than the lower limit A, the monitor key number KEYM is computed with respect to each key number KEYNO in the range of A to B and written in the monitor transposition table 33.

Description will now be made about a processing executed in a case where the upper limit B of the record part is smaller than the lower limit A, i.e., as shown in FIG. 7, the high tone range and the low tone range have been selected as the record part and the middle tone range has been selected as the playback part.

In this case, result of the judgement in step S101 becomes NO and the subroutine proceeds to step S400 in which the octave number Cm of the playback part is computed in accordance with the following formular (8).

$$Cm \leftarrow INT\{(A-B-1)/12\} \quad (8)$$

The subroutine then proceeds to step S510 in which whether or not Cm×12≧88−(A−1) exists, i.e., whether or not the respective key numbers in the high tone side record part can be transposed in their entirety to the playback part (having a tone range of Cm octaves or over), is judged. If result of the judgement is YES, the subroutine proceeds to step S411 in which the transposition octave number TR is computed by the following formula (9):

$$TR \leftarrow INT\{(88-A)/12+1\} \quad (9)$$

By transposing Key numbers KEYNO belonging to the range A to 88 to the lower tone side by TR octaves, a processing of computing a monitor event key number KEYM (step S412) and a processing of writing a key number KEYNO in the playback event and a monitor event key number KEYM corresponding thereto in the monitor transposition table 33 (step S412) are repeated (step S414).

If the tone range in the playback part is narrow and therefore Cm×12<88−(A−1), result of the judgement in step S410 becomes NO and the subroutine proceeds to step S420 in which whether Cm≧1 exists or not is judged. If result of the judgement is YES, i.e., the playback part is one octave or over, the subroutine proceeds to step S421 in which the transposition octave number TR is initially set to Cm. Then, the following steps S422 to S426 are executed with respect to the key numbers KEYNO belonging to the range A to 88.

First, in step S422, a control variable EN is initially set to A+TR×12. Then, the subroutine proceeds to step S423 in which the monitor key number KEYM is computed by transposing the key number KEYNO to the lower tone side by TR octaves. The subroutine then proceeds to step S424 in which the key number KEYNO and the corresponding monitor key number KEYM are written in the monitor transposition table 33. The subroutine then proceeds to step S425 in which whether or not the key number KEYNO is smaller than the control variable EN is judged. If result of the judgement is YES, the key number KEYNO is incremented and steps S421 to S425 are executed again. When they key number KEYNO has been incremented to the control variable EN, result of the judgement in step S425 becomes NO and the subroutine proceeds to step S426 in which the transposition octave number TR is increased by one octave. The subroutine retuns to step S422 if the number KEYNO is less than 88. By executing the above processing, a transposition amount of Cm octaves on the lower tone side is applied to the key numbers KEYNO in the range of A to $A+(CM\times 12-1)$ (see the arrow Rd in FIG. 7) and a transposition amount of $Cm+1$ octaves on the lower tone side is applied to the key numbers KEYNO in the range of $A+(Cm\times 12)$ to $A+\{(Cm+1)\times 12-1\}$ (see the arrow Re in FIG. 7) and, as the decrease in the key number of the playback event from B has amounted to one octave, the amount of transposition is increased by one octave. Table information showing correspondence between the playback event key numbers KEYNO in the higher tone side record part and the monitor event key numbers KEYM resulting from the transposition by the above amounts of transposition is obtained in the monitor transposition table 33.

If the playback part has not reached one octave, result of the judgement in step S420 becomes NO and the subroutine proceeds to step 430. The monitor key number KEYM is computed by employing a processing similar to the above described steps S421 to S427 and, if a proper monitor key number KEYM has been obtained, the monitor key number KEYM is written in the monitor transposition table 33. If, in this case, the monitor key number KEYM has come outside of the playback part, writing of the monitor key number KEYM in the table is not made but information prohibiting playback of the particular key number KEYNO is written in the monitor transposition table 33.

In the foregoing manner, the monitor key number KEYM corresponding to the high tone side record part is computed and stored in the monitor transposition table 33. Then, as will be described below, the monitor key number KEYM corresponding to the respective key numbers KEYNO in the low tone side record part is computed.

Upon completion of steps S413, S427 or S430, the subroutine proceeds to step S510 in which whether or not $Cm\times 12\geqq B$ exist, i.e, wheter or not playback keys in the half area on the low tone side record part can be transposed in their entirety to the playback part is judged. If result of the judgement is YES, the subroutine proceeds to step S511 in which the transposition octave number TR is computed in accordance with the following formula (10):

$$TR\leftarrow INT(B/12+1) \qquad (10)$$

Then, by transposing the key number KEYNO belonging to the range 1 to B to the higher tone side by TR octaves, a processing of computing the monitor event key number KEYM (step S512) and a processing of writing the key number KEYNO in the playback event and the corresponding monitor event key number KEYM in the monitor transposition table 33 (step S513) are repeated (step S514). In this manner, the transposition amount of TR octaves is applied to each playback event in the low tone side record part (see the arrow Rf in FIG. 7).

If the tone tange in the playback part is narrow, i.e., $Cm\times 12<B$, result of the judgement in step S510 becomes NO and the subroutine proceeds to step S520 in which whether $Cm\geqq 1$ exists or not is judged. If result of the judgement is YES, i.e., the playback part is one octave or over, the subroutine proceeds to step S521 in which Cm is initially set to the transposition octave number TR. Then, steps S522 to S527 to be described below are executed for the key numbers KEYNO belonging to the range 1 to B.

In step 522, $B-TR\times 12$ is set to the control variable EN. Then the subroutine proceeds to step S523 in which the monitor key number KEYM is computed by transposing the key number KEYNO to the higher tone side by TR octaves. Then the subroutine proceeds to step S524 in which the key number KEYNO and the corresponding monitor key number KEYM are written in the monitor transposition table 33. The subroutine further proceeds to step 525 in which whether or not the key number KEYNO is larger than the control variable EN is judged. If result of the judgement is YES, the key number KEYNO is decremented and steps S522 to S525 are executed again. As the key number KEYNO has been decremented to the control variable EN, result of the judgement in step 525 becomes NO and the subroutine proceeds to step S526 in which the transposition octave number TR is increased by one octave. If the key number KEYNO exceeds 1 (step S527), the subroutine returns to step S522.

If the playback part is less than one octave, result of the judgement in step S520 becomes NO and the subroutine proceeds to step S530. If a proper monitor key number KEYM has been obtained by the computation of the monitor key number KEYM by a processing similar to the above described steps S521 to S527, the monitor key number KEYM is written in the monitor transposition table 33. If the monitor key number KEYM has come outside of the playback part, writing of the monitor key number KEYM in the table is not made but information prohibiting playback of the particular key number KEYM is written in the monitor transposition table 33.

In the foregoing manner, the automatic preparation of the monitor transposition table 33 is completed and the program proceeds to step S2 in FIG. 3 in which the playback sequence module 32 of the sequencer 31 is started and playback events are read from the file X in the floppy disk FD. The playback sequence module 32 judges whether or not there is a monitor key number KEYM corresponding to the key number KEYNO of the playback event in the monitor transposition table 33. If the monitor key number KEYM is stored in the table 33, the key number in the playback event is converted to the monitor key number KEYM stored in the monitor transposition table 33 and is supplied to the key drive unit 41 as the monitor event. If no monitor key number KEYM corresponding to the key number KEYNO in the playback event is stored in the table 33, the playback event is directly supplied to the key drive unit 41. IF, however, information prohibiting playback of the key number KEYNO is stored in the table 33, outputting of the monitor event corresponding to the particular key number KEYNO is not made.

Upon supply of the monitor event, the key drive unit 41 causes a drive current to be supplied to the key drive solenoid corresponding to the monitor event key event KEYM and sounding of the tone corresponding to the key is made.

Upon completion of step S2, the program proceeds to step S3 in which the recording sequence module 37 is started. When the performer has operated a kay in the keyboard, the number of the operated key is detected by the key sensor unit 42 and a record event containing the key number of the operated key as information is supplied to the recording sequence module 37 of the sequencer 31. If the record event has already been supplied to the recording sequence module 37 at the time of starting of the recording sequence module 37, the recording sequence module 37 refers to the lower limit A and upper limit B of the record part stored in the overdubbing record table 34. As shown in the flow chart of FIG. 9, the recording sequence module 37 judges whether or not the key number of the record event belongs to the record part and supplies the record event to the merger module 35 only when the key number of the record event belongs to the record part.

Figure 8:
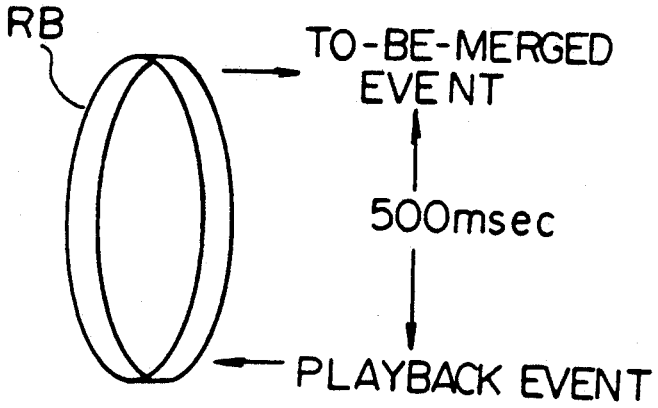
FIG. 8 is a diagram illustrating the operation of a delay module 36 in the same embodiment.
Figure 9:
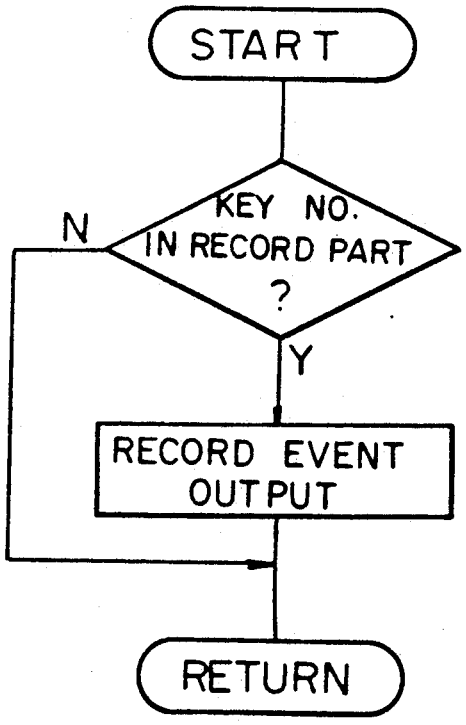
FIG. 9 is a flow chart showing the operation of a record sequence module 37 in the same embodiment.
Figure 10:
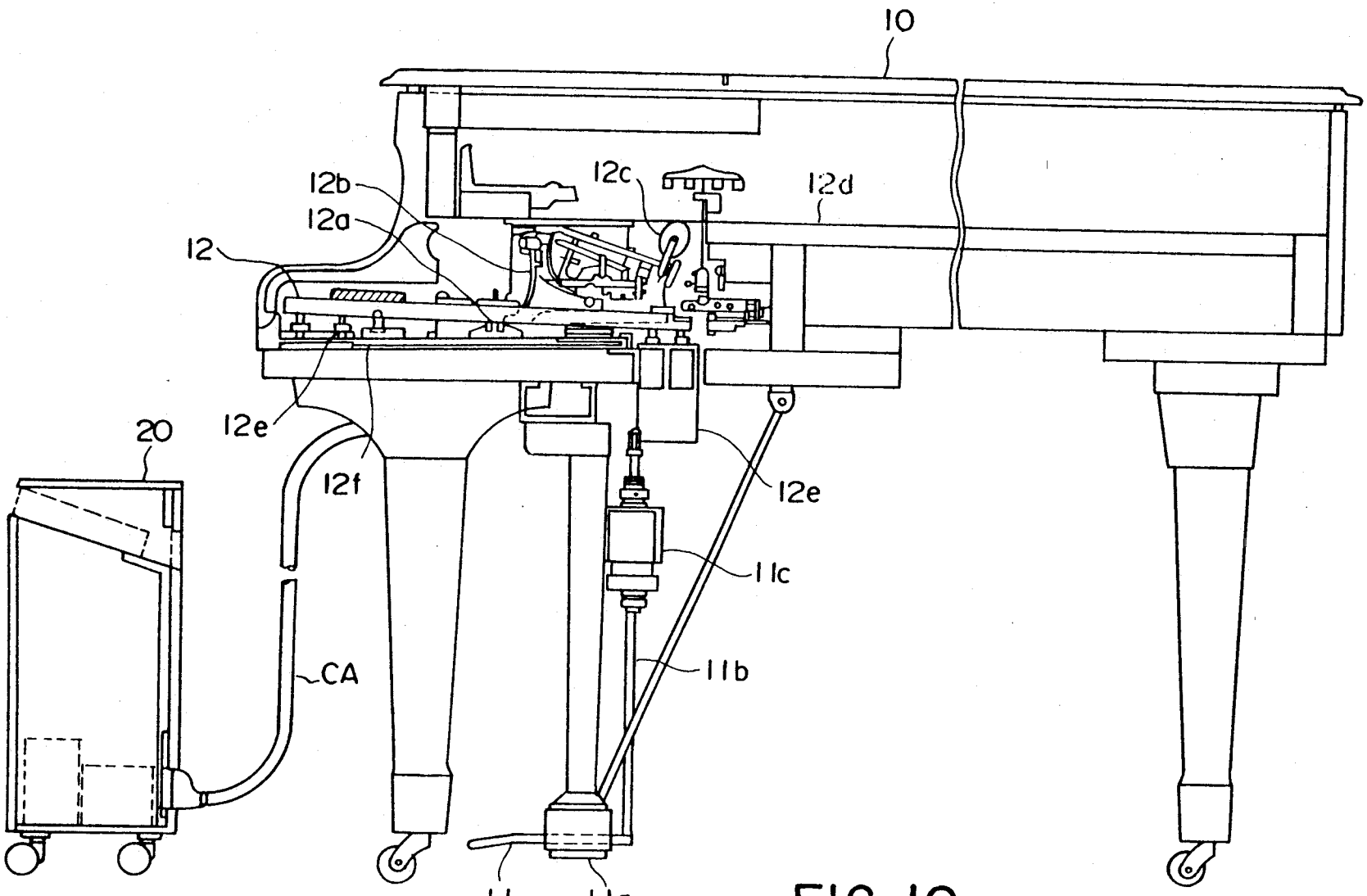
FIG. 10 is a diagram showing a partly sectional side elevation of a prior art automatic performance piano.

Then, the program proceeds to step S4 in which the delay module 36 is started. This delay control module 36 accumulates, as shown in FIG. 8, playback events (i.e., events before being transposed to the monitor events) read from the floppy disk FD by the playback sequence module 32 of the sequencer 31 sequentially in a ring buffer RB thereby controlling time elapsed from a time point at which each playback event has occurred. If, at the time point at which the delay module 36 is started, there is a playback event which has elapsed a predetermined period of time (e.g., 500 msec in the present embodiment but this time can be designated by an operator in the operation unit within a range of 0 to 700 msec), this playback event is supplied to the merger module 35 as a to-bo-merged event. The delay control can be made not only by employing the above described ring buffer but also by employing a delay control module including a data buffer which sequentially accumulates playback events, a read pointer which moves a read point in the data buffer as time elapses and an output buffer which reads a playback event from a read point in the data buffer designated by the read pointer and providing a playback event which has reached a predetermined delay time from the output buffer.

The program then proceeds to step S5 in which the merger module 35 is started and the to-be-merged event supplied from the delay module 36 and the record module supplied from the recording sequence module 37 in accordance with the overdubbing recording table 34 are merged together. The merged event is supplied to the recording sequence module 37 as a final record event. The program then proceeds to step S6 in which the control is passed to a DOS control module. The final record event is recorded in the file Y by the DOS control module.

According to the synthetic recording device of the invention, a transposition amount for each key in the record part is automatically computed by only an operation for designating the record part and a playback event which is read from the floppy disk FD and belongs to the record part is automatically transposed on octave basis to the playback part. A music performance made with its tone pitch being transposed midway in an octave generally gives an impression which is entirely different from the original music. By performing music with a transposition made on the octave basis as in the present embodiment, no such undesirable impression is produced.

Therefore, according to the synthetic recording device of the invention, an optimum transposition is automatically made so that playback can be made without impairing the image of music which has already been stored in the floppy disk FD. Besides, the record part and the playback part are clearly distinguished from each other and record events in the record part only are merged with playback events for being recorded in the floppy disk FD so that an accurate overdubbing can be achieved.

In the above described embodiment, in a case where the middle tone range has been selected as the record part, a half area on the higher tone side is transposed to the high tone side playback part and a half area on the lower tone side is transposed to the low tone side playback part. Alternatively, all key numbers in the record part may be transposed to either one of the high tone side playback part and the low tone side playback part which has a broader tone range.

What is claimed is:

1. A synthetic recording device in an automatic performance piano conducting an automatic performance in response to playback performance information read from memory means and, simultaneously, detecting keys operated by a performer from among keys provided in a keyboard and generating record performance information in accordance with a result of detection, and storing performance information obtained by synthesizing the record performance information and the playback performance information in the memory means, comprising:

key range setting means for setting, as a record area, a range of keys in which the record performance information is to be generated;

transposition means for transposing, when the playback performance information corresponds to a key within the range set by the key range setting means, the playback performance information by a predetermined amount of transposition and outputting the transposed playback performance information;

piano performance means for performing playback in response to the transposed playback performance information and detecting a state of operation of keys in the keyboard to provide key operation information;

selection means for selecting key operation information corresponding to a key in the record area from amont the key operation information provided by the piano performance means and outputting the selected information as the record performance information;

delay means for delaying the playback performance information by a predetermined period of time determined on the basis of dynamic characteristics of a string hammering section of the automatic performance piano; and synthetic recording means for synthesizing the delayed playback performance information and the record performance information and providing the synthesized information to the memory means to be stored therein.

2. A synthetic recording device as defined in claim 1 wherein said key range setting means sets, as the record area, a middle tone range in the keyboard.

3. A synthetic recording device as defined in claim 2 wherein said transposition means transposes a higher tone side half of the playback performance information corresponding to keys in the middle tone range to a high tone range and a lower tone side half of the playback performance information corresponding to keys in the middle tone range to a low tone range.

4. A synthetic recording device as defined in claim 2 wherein said transposition means transposes all of the playback performance information corresponding to keys in the middle tone range to either one of a high tone range and a low tone range which has a broader tone range.

5. A synthetic recording device as defined in claim 1 wherein said key range setting means sets, as the record area, a high tone range and a low tone range in the keyboard and said transposition means transposes the playback performance information corresponding to keys in the high tone range and the low tone range to a middle tone range.

6. A synthetic recording device as defined in claim 1 wherein said transposition means transposes the playback performance information on octave basis.

* * * * *